US011506397B2

(12) United States Patent
Johnson

(10) Patent No.: US 11,506,397 B2
(45) Date of Patent: Nov. 22, 2022

(54) DEBRIS DIVERTER COMPONENT FOR PREVENTING DAMAGE TO OVEN APPLIANCE FAN

(71) Applicant: Haier US Appliance Solutions, Inc., Wilmington, DE (US)

(72) Inventor: Eric Scott Johnson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/096,231

(22) Filed: Nov. 12, 2020

(65) Prior Publication Data

US 2022/0146112 A1 May 12, 2022

(51) Int. Cl.
*F24C 15/00* (2006.01)
*F24C 15/32* (2006.01)
*F24C 15/20* (2006.01)

(52) U.S. Cl.
CPC ..... *F24C 15/006* (2013.01); *F24C 15/322* (2013.01); *F24C 15/2007* (2013.01)

(58) Field of Classification Search
None
See application file for complete search history.

(56) References Cited

U.S. PATENT DOCUMENTS

| | | | | |
|---|---|---|---|---|
| 3,353,004 | A * | 11/1967 | Alexander | F24C 14/02 219/393 |
| 4,490,596 | A | 12/1984 | Amagami | |
| 4,951,646 | A | 8/1990 | Cramer | |
| 10,480,798 | B2 | 11/2019 | Worrell | |
| 2018/0245797 | A1* | 8/2018 | Johnson | F24C 15/006 |
| 2018/0335217 | A1 | 11/2018 | Bruckbauer | |
| 2019/0212014 | A1* | 7/2019 | Chadwick | F24C 15/006 |
| 2020/0232651 | A1* | 7/2020 | Huang | F24C 15/2007 |

* cited by examiner

*Primary Examiner* — Jason Lau
(74) *Attorney, Agent, or Firm* — Dority & Manning, P.A.

(57) ABSTRACT

An oven appliance includes a cooking chamber for receipt of a food for cooking and an air exhaust channel having an air inlet and an air outlet. The air inlet is for directing air flowing adjacent to the cooking chamber into the air exhaust channel, whereas the air outlet is for directing the air out of the air exhaust channel. The oven appliance also includes a fan configured for causing air to flow from the cooking chamber and through the air exhaust channel. Further, the oven appliance includes a debris diverter component arranged with the air exhaust channel for preventing debris or liquid from contacting the fan.

20 Claims, 9 Drawing Sheets

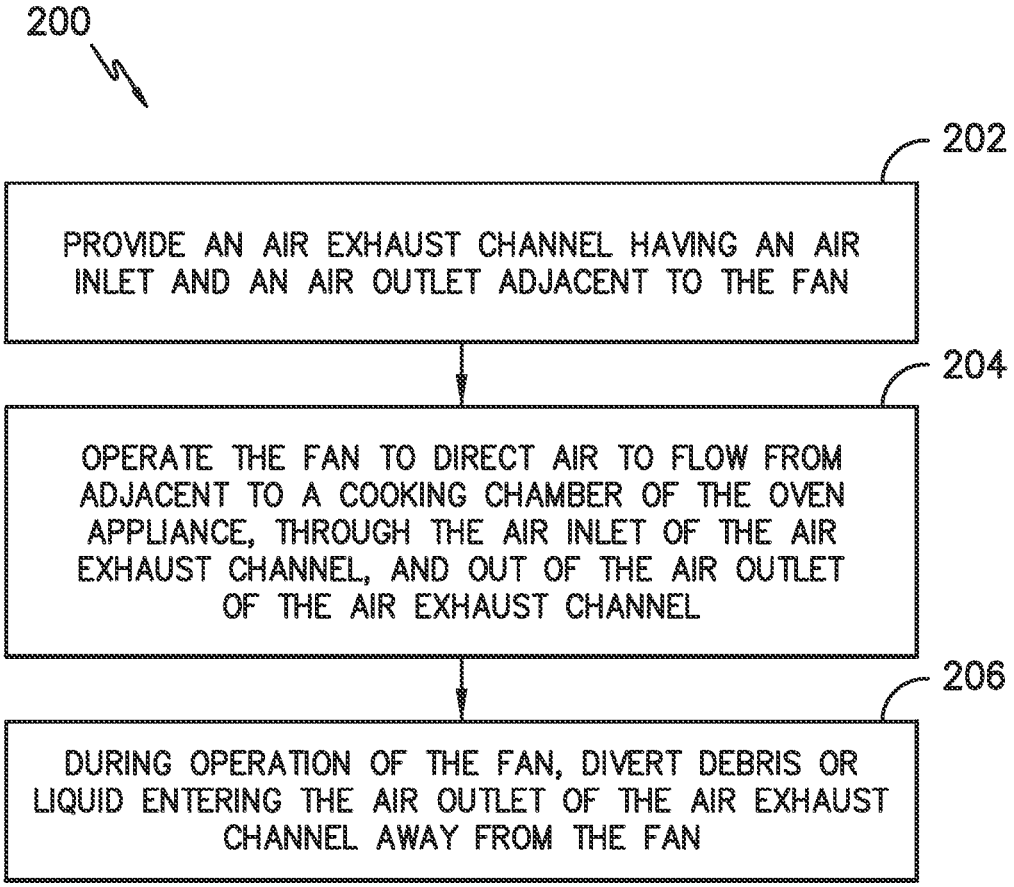
*FIG. –15–*

DEBRIS DIVERTER COMPONENT FOR PREVENTING DAMAGE TO OVEN APPLIANCE FAN

FIELD OF THE INVENTION

The subject matter of the present disclosure generally relates to oven appliances and, more particularly, to a debris diverter component for preventing damage to a fan of an oven appliance.

BACKGROUND OF THE INVENTION

Oven appliances generally include an insulated and heated oven cavity for baking food items therein. An opening to the oven cavity is covered by an insulated door movable between an open position and a closed position. Commonly, the door includes a transparent panel allowing a user to view the contents of the oven cavity, such as various food items, with the door in the closed position. In addition, modern oven appliances are commonly equipped with a cooling fan and an exhaust vent at the rear of the oven appliance for cooling parts mounted outside the insulated oven cavity. Accordingly, the cooling fan moves air across the outside of the insulated oven cavity and through the exhaust vent.

For typical constructions, the cooling fan is located adjacent to a top portion of the rear oven wall to allow air to be easily expelled through the exhaust vent. To allow the air to exit the exhaust vent, the vent is typically open. As such, debris and/or liquid may fall into the air outlet of the exhaust vent, which may cause damage to or clogging of the cooling fan.

Accordingly, the present disclosure is directed to a debris diverter component for the exhaust vent to prevent debris and/or liquid from causing the aforementioned issues.

BRIEF DESCRIPTION OF THE INVENTION

Aspects and advantages of the invention will be set forth in part in the following description, or may be obvious from the description, or may be learned through practice of the invention.

In an aspect, the present disclosure is directed to an oven appliance. The oven appliance includes a cooking chamber for receipt of a food for cooking. The oven appliance also includes an air exhaust channel having an air inlet and an air outlet. The air inlet is for directing air flowing adjacent to the cooking chamber into the air exhaust channel, whereas the air outlet is for directing the air out of the air exhaust channel. The oven appliance also includes a fan configured for causing the air to flow through the air exhaust channel. Further, the oven appliance includes a debris diverter component arranged with the air exhaust channel for preventing debris or liquid from contacting the fan.

In another aspect, the present disclosure is directed to a method for preventing debris or liquid from damaging a fan of an oven appliance. The method includes providing an air exhaust channel having an air inlet and an air outlet adjacent to the fan. The method also includes operating the fan to direct air to flow from adjacent to a cooking chamber of the oven appliance, through the air inlet of the air exhaust channel, and out of the air outlet of the air exhaust channel. Further, the method includes, during operation of the fan, diverting debris or liquid entering the air outlet of the air exhaust channel away from the fan.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 15 illustrates a flow diagram of one embodiment of a method for preventing debris or liquid from damaging a fan of an oven appliance according to the present disclosure.

The use of similar or identical reference numerals in the figures indicates similar or identical features.

DETAILED DESCRIPTION OF THE INVENTION

Figure 1:
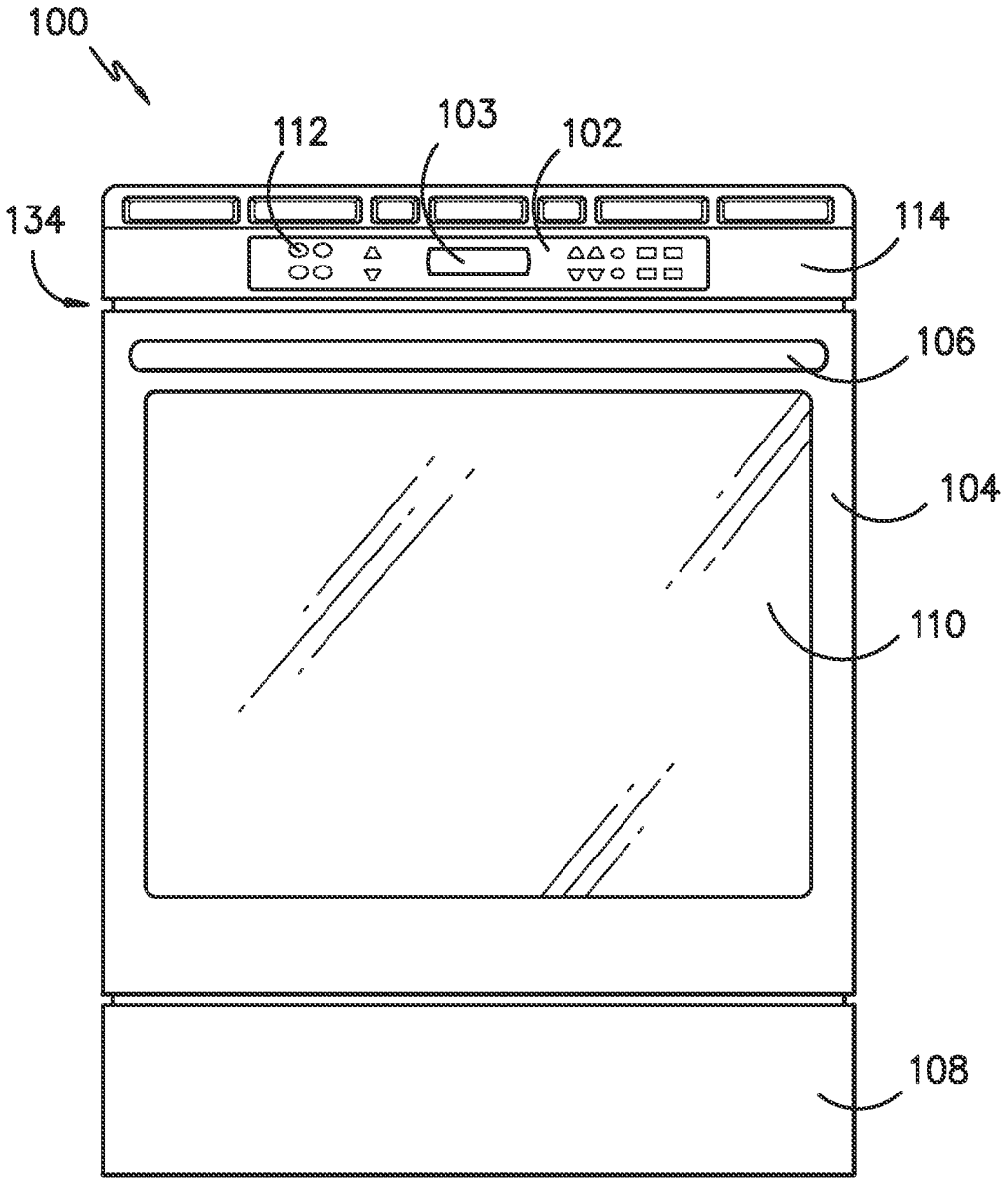
FIG. 1 illustrates a front view of an exemplary embodiment of an oven appliance according to the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to the figures, FIG. 1 illustrates a front view of an exemplary embodiment of an oven appliance 100 according to the present disclosure. As shown, the oven appliance 100 includes a door 104 with a handle 106 that provides for opening and closing access to a cooking chamber 105. A user of the oven appliance 100 can place a variety of different items to be cooked into the cooking chamber 105. Further, as shown, the oven appliance 100 may include one or more heating sources (not shown) at the top, bottom, or sides of the cooking chamber 105 for providing a heat source for cooking items in the cooking chamber 105. The heating source(s) can be gas, electric, microwave, or a combination thereof. Moreover, as shown, the oven appliance 100 may include one or more racks (not shown) within the cooking chamber 105 that can be used to place food items at various levels within the cooking chamber 105 for cooking. In addition, as shown, the oven appliance 100 may further include a window 110 on the door 104 to allow a user to view e.g., food items during the cooking process.

In certain embodiments, the oven appliance 100 may include a user interface 102 having a display 103 positioned on a top panel 114 with a variety of controls 112. Accordingly, the user interface 102 allows the user to select various options for the operation of the oven appliance 100 including e.g., temperature, time, and/or various cooking and cleaning cycles. Operation of the oven appliance 100 can be regulated by a controller (not shown) that is operatively coupled i.e., in communication with, the user interface 102 and other components of the oven appliance 100 as will be further described.

By way of example, the controller may include a memory and one or more processing devices such as microprocessors, CPUs or the like, such as general or special purpose microprocessors operable to execute programming instructions or micro-control code associated with operation of the oven appliance 100. The memory may represent random access memory such as DRAM, or read only memory such as ROM or FLASH. In one embodiment, the processor executes programming instructions stored in memory. The memory may be a separate component from the processor or may be included onboard within the processor.

Although shown with touch type controls 112, it should be understood that controls 112 and the configuration of the oven appliance 100 shown in FIG. 1 is provided by way of example only. More specifically, the user interface 102 may include various input components, such as one or more of a variety of electrical, mechanical or electro-mechanical input devices including rotary dials, push buttons, and touch pads. Further, the user interface 102 may include other display components, such as a digital or analog display device designed to provide operational feedback to a user. The user interface 102 may be in communication with the controller via one or more signal lines or shared communication busses. Also, the oven appliance 100 is shown as an oven with a stove-top or range, but the present invention could also be used with other appliances such as e.g., a wall oven and other configurations as well.

As stated, during operation of oven appliance 100 in both cooking and cleaning cycles, the temperatures that are needed in the cooking chamber 105 can be high. As such, insulation in the various oven walls may be provided to help reduce heat transfer from the oven appliance 100 to e.g., surrounding cabinetry or ambient air. Further, the door 104 may also include insulation as well. A gasket (not shown) between the door 104 and the walls may further provide thermal insulation but also allows a certain amount of ambient air to be drawn into the cooking chamber 105 during certain cooking operations.

Figure 2:
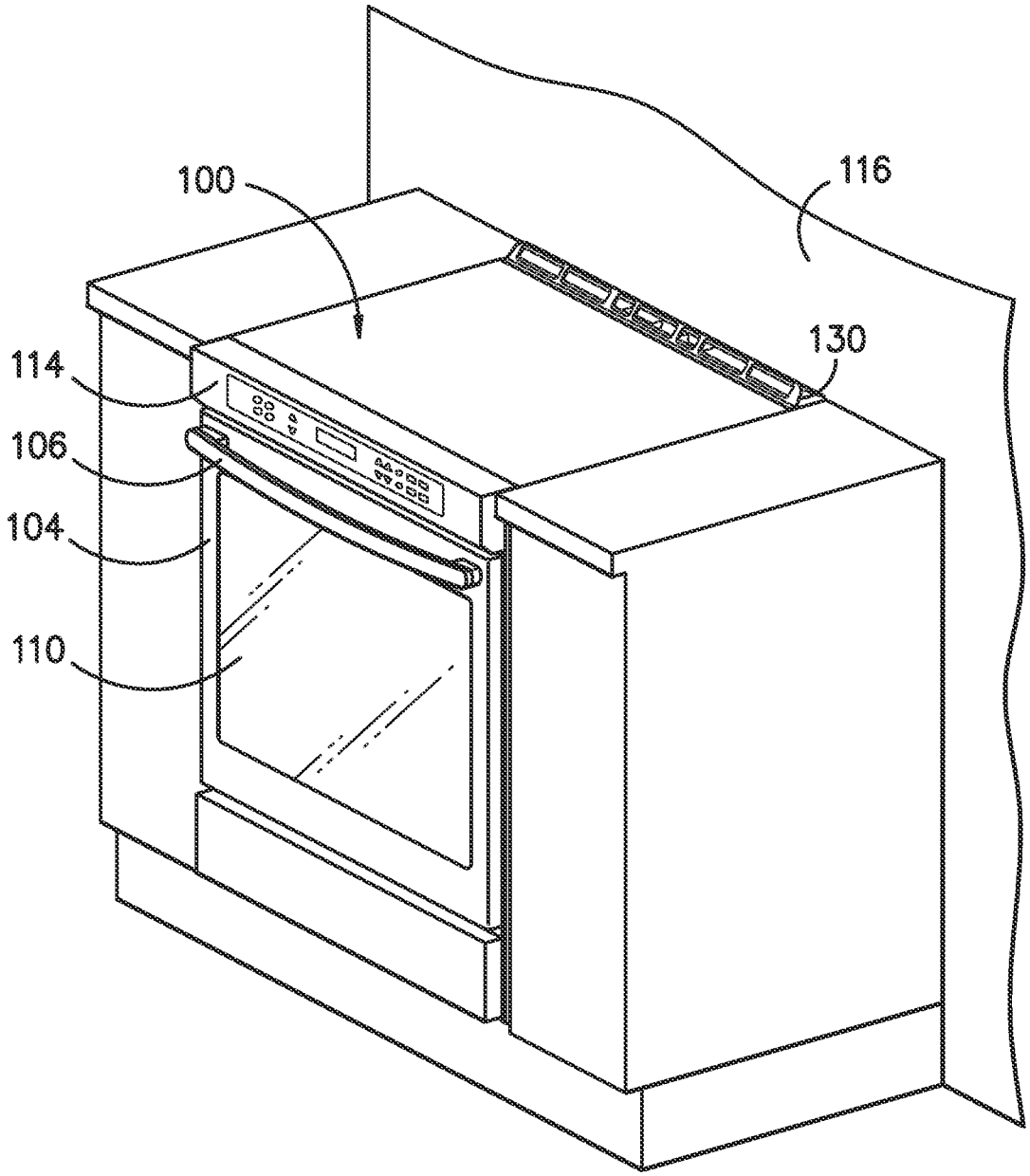
FIG. 2 illustrates a perspective view of an exemplary embodiment of an oven appliance according to the present disclosure, particularly illustrating the oven appliance installed against a wall and having an air exhaust channel.
Figure 3:
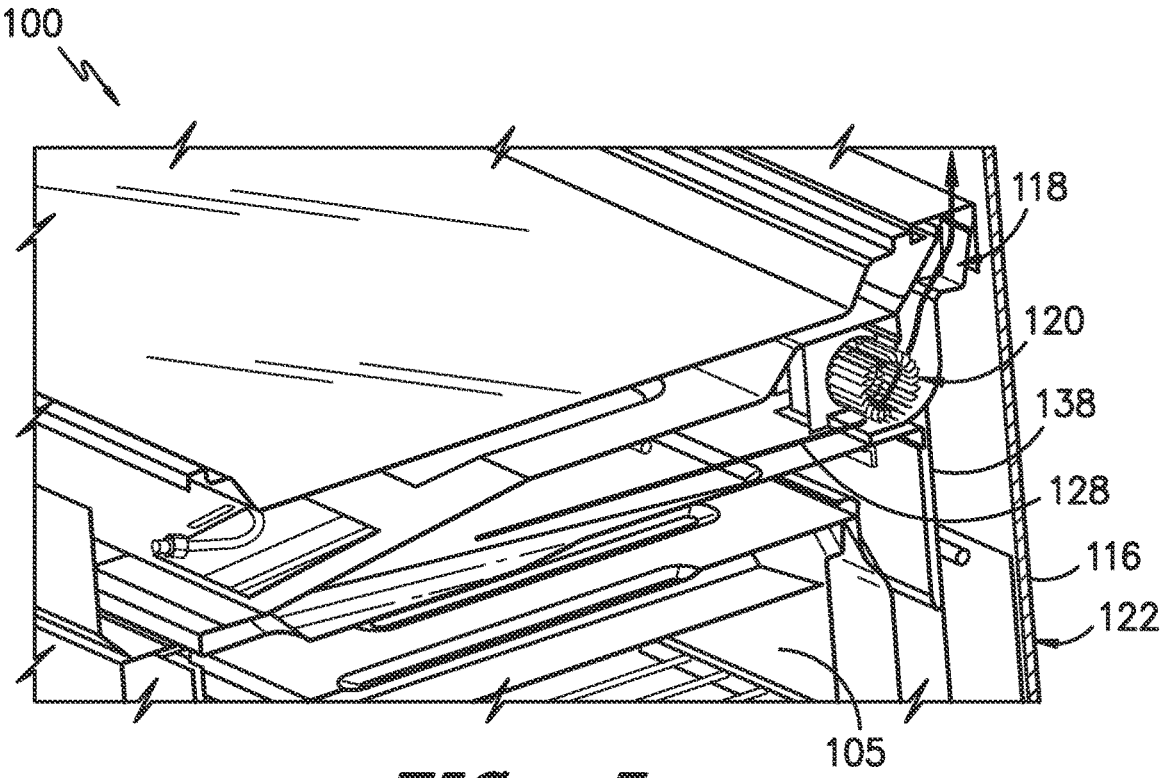
FIG. 3 illustrates a partial, perspective side view of an exemplary embodiment of an oven appliance according to the present disclosure, particularly illustrating an outer wall removed to expose details of the air exhaust channel.
Figure 4:
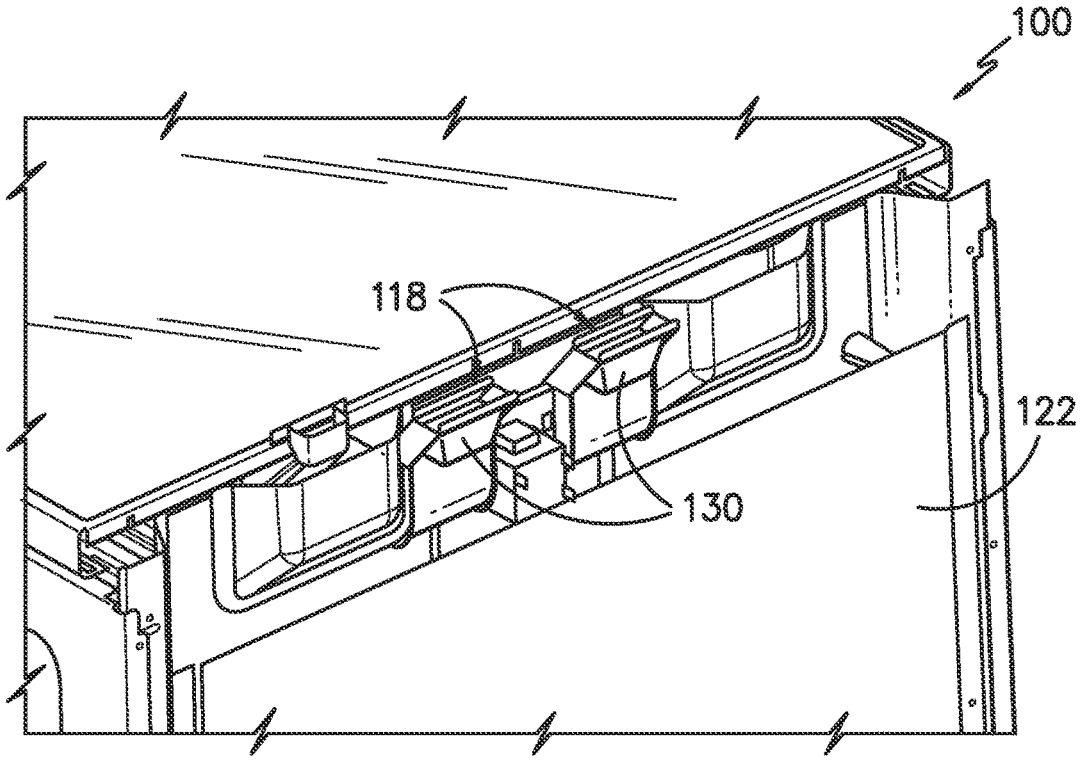
FIG. 4 illustrates a partial, perspective rear view of an exemplary embodiment of an oven appliance according to the present disclosure, particularly illustrating details of the air exhaust channel.

Referring now to FIGS. 2-4, various views of an embodiment of the oven appliance 100 described herein installed against a wall 116 according to the present disclosure is illustrated. In particular, as shown, the oven appliance 100 is provided with a cooling system whereby ambient air is used to help cool the oven appliance 100. Moreover, as shown, the oven appliance 100 may include a vent 130, for example, adjacent to the rear wall 116 for expelling air therefrom. In addition, as shown in FIGS. 3 and 4, the oven appliance 100 also includes an air exhaust channel 118 adjacent the wall 116. Further, as shown, the air exhaust channel 118 of the oven appliance 100 may be positioned above a cooling fan 120. In addition, the air exhaust channel 118 is shown schematically in the figures. As will be understood by one of skill in the art using the teachings disclosed herein, the air exhaust channel 118 may have a variety of configurations other than as shown.

Figure 5:
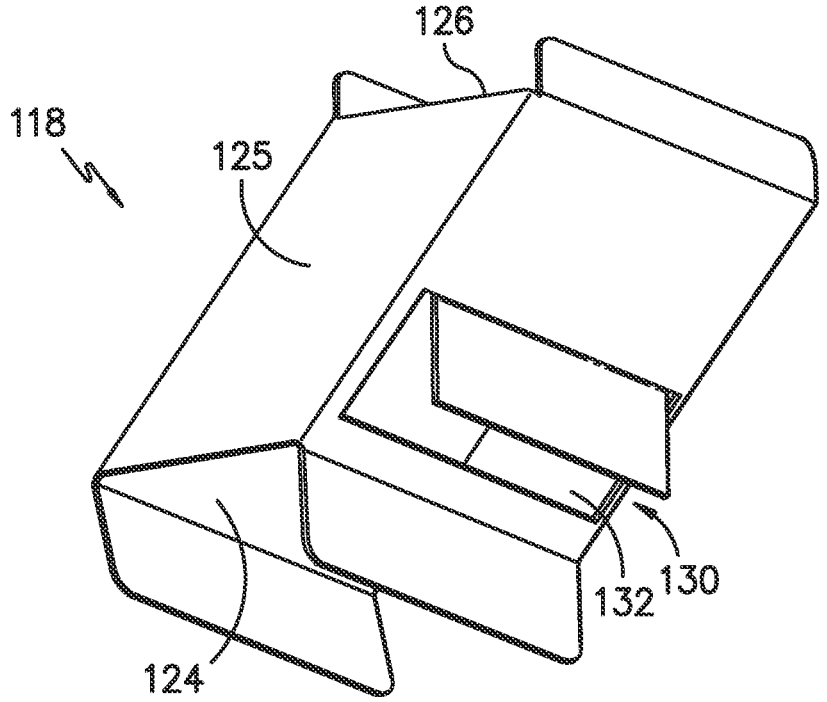
FIG. 5 illustrates a perspective rear view of an exemplary embodiment of an air exhaust channel of an oven appliance according to the present disclosure.

For example, as shown in FIGS. 3-5, the air exhaust channel 118 may be configured as a pathway adjacent to vertically-oriented wall 122, such as a rear wall or wire cover, of the oven appliance 100. Further, as shown in FIG. 3, the air exhaust channel 118 may be configured as a chute or conduit between the rear wall 122 of the oven appliance 100 and a vertically-extending structural wall 138 of the oven appliance 100. In still other embodiments, a variety of configurations may be used provided a channel is created for the flow of air from adjacent to the cooking chamber 105 (e.g. above the cooking chamber 105) to a location outside of the oven appliance 100. Furthermore, as shown in FIG. 5, the air exhaust channel 118 may include a body 125 extending at an angle between an air inlet 124 and an air outlet 126. Thus, the air inlet 124 allows the flow of air from adjacent to the cooking chamber 105 and into the air exhaust channel 118, whereas the air outlet 126 allows the flow of air from the air exhaust channel 118 to exit the air exhaust channel 118. In example embodiments, the angle of the body 125 may be less than about 90 degrees.

Accordingly, during operation, as shown particularly in FIG. 3, the cooling fan 120 moves air from adjacent to the cooking chamber 105 and through the air exhaust channel 118 by drawing air through the air inlet 124 of the air exhaust channel 118. The air then exits from the air exhaust channel 118 via the air outlet 126. The flow of air through the air exhaust channel 118, for example, is indicated by arrows 128 in FIG. 3.

Figure 6:
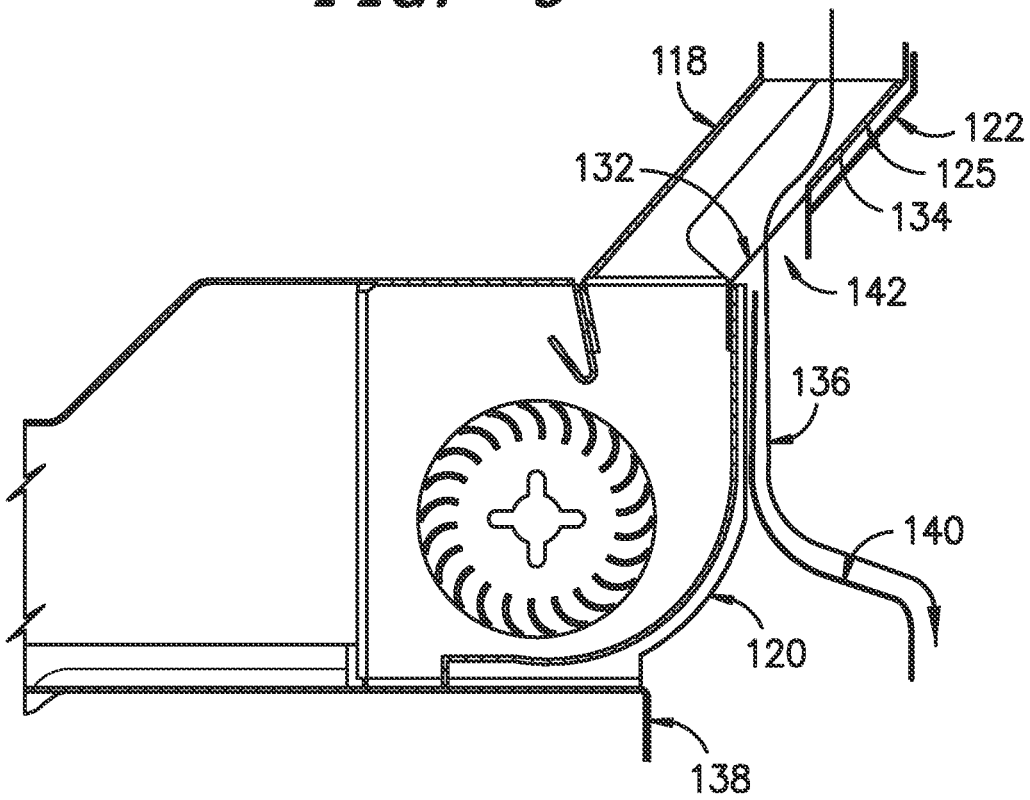
FIG. 6 illustrates a side view of an embodiment of an air exhaust channel arranged with a cooling fan of an oven appliance according to the present disclosure, particularly illustrating a debris diverter component having an inset region.
Figure 7:
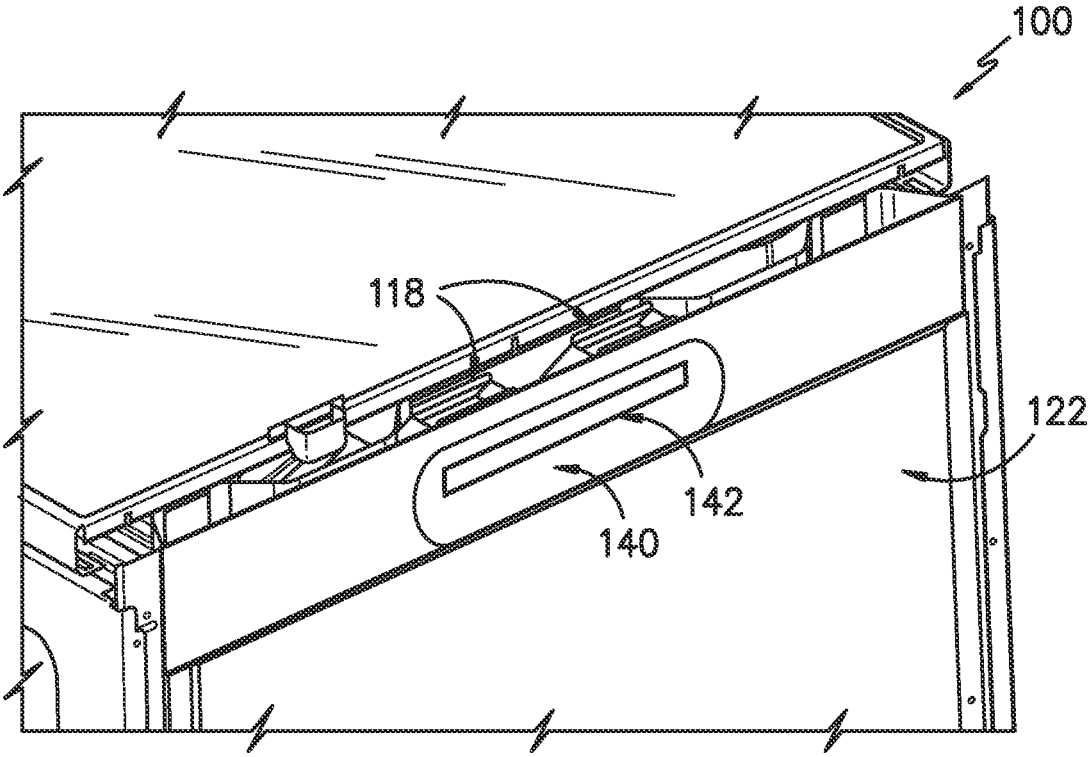
FIG. 7 illustrates a rear view of the oven appliance of FIG. 6.

Referring now to FIGS. 4-14, the oven appliance 100 also includes a debris diverter component 130 arranged with the air exhaust channel 118 for preventing debris and/or liquid from contacting the fan 120. Furthermore, as shown in the illustrated embodiment, the debris diverter component 130 may be arranged adjacent to the vertically-oriented wall 122. Moreover, the debris diverter component 130 described herein may have a variety of configurations. For example, as shown in FIGS. 5-7, the debris diverter component 130 may include a first opening 132 formed in a lower surface 134 of the angled body 125 of the air exhaust channel 118, wherein the debris and/or the liquid exits the first opening 132 via gravity. Moreover, as shown in FIG. 6, the vertically-oriented wall 122 may include a second opening 142 aligned with the first opening 132. In addition, as shown, the vertically-oriented wall 122 may further include an inset region 140. Thus, in such embodiments, the debris and/or liquid that exits the first opening 132 of the debris diverter component 130 (as shown via arrow 136) also exits the second opening 142 of the vertically-oriented wall 122 and is further diverted away from the fan 120, as shown, via the inset region 140 of the vertically-oriented wall 122. In such embodiments, the debris/liquid is allowed to fall down the outside surface of the wall 122.

Figure 8:
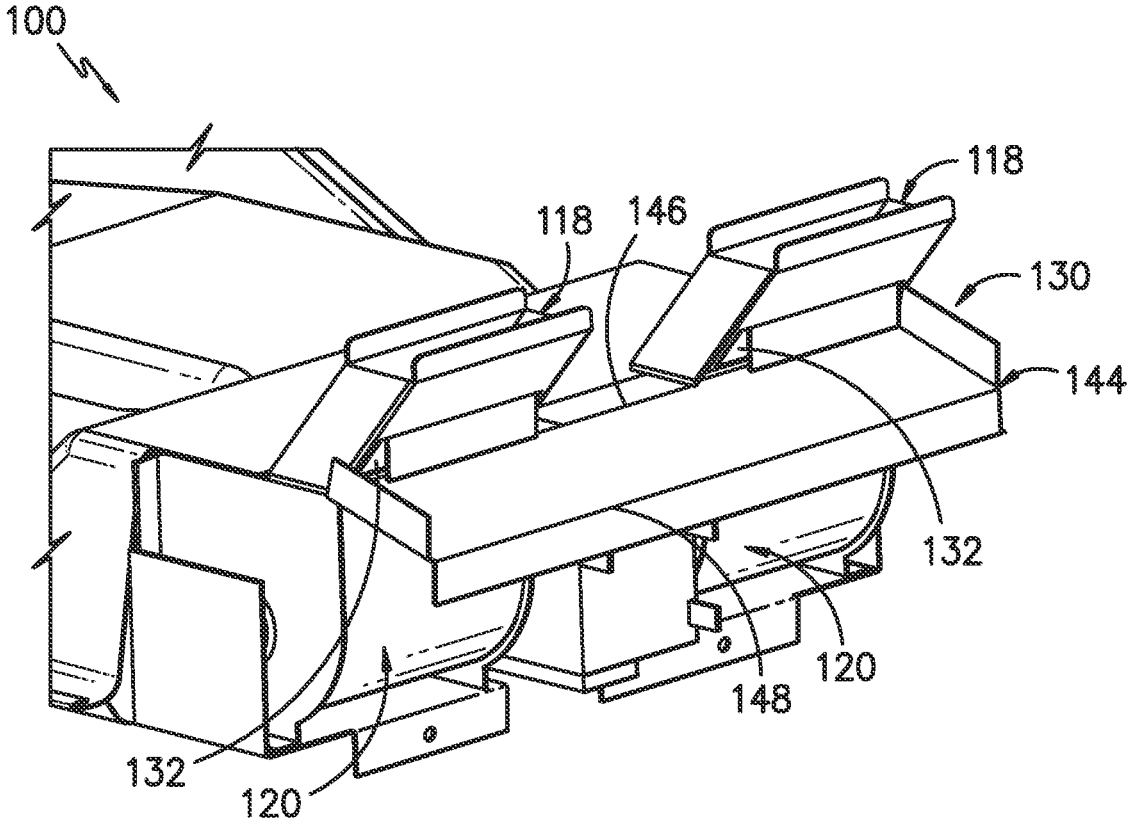
FIG. 8 illustrates a perspective view of an embodiment of an air exhaust channel arranged with a cooling fan of an oven appliance according to the present disclosure, particularly illustrating a debris diverter component being a tray.
Figure 9:
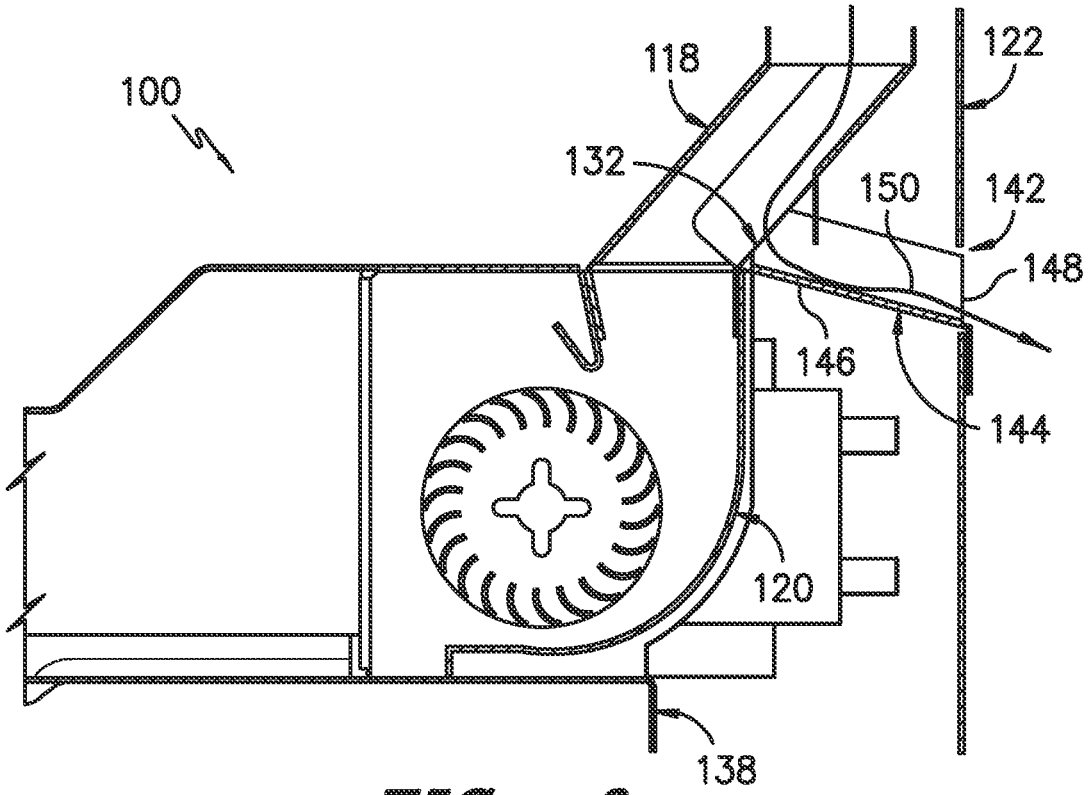
FIG. 9 illustrates an internal, side view of the oven appliance of FIG. 8.
Figure 10:
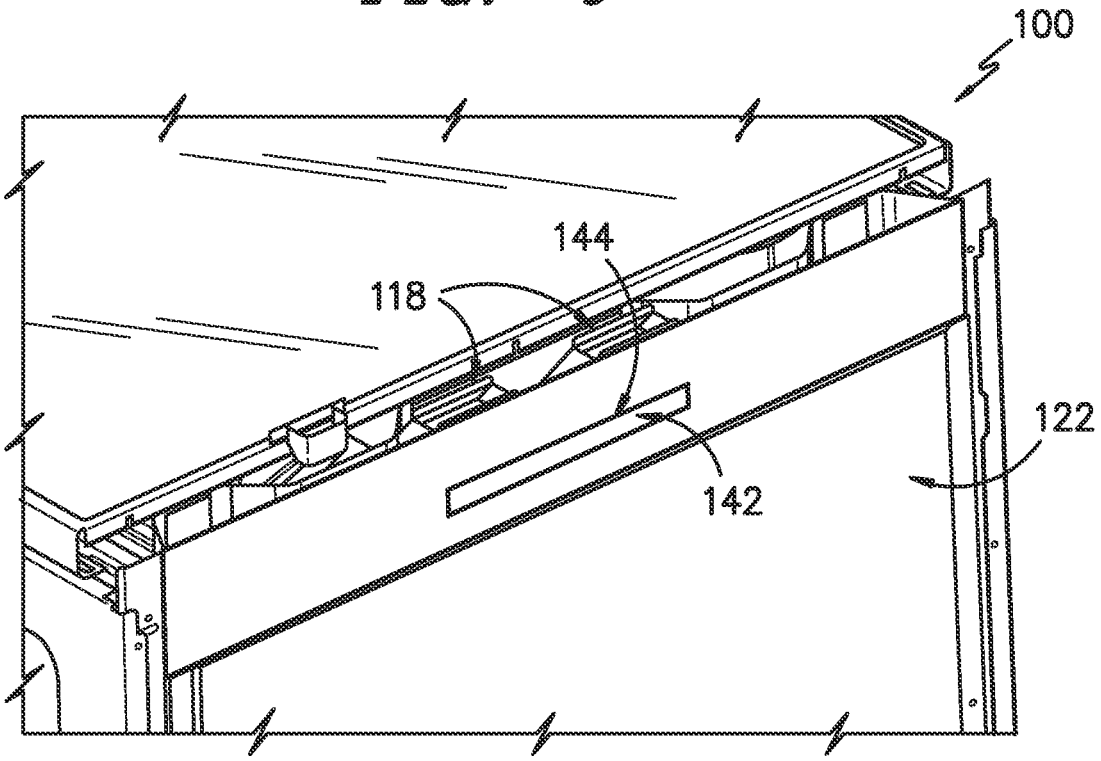
FIG. 10 illustrates an exterior, rear view of the oven appliance of FIG. 8.

Referring now to FIGS. 8-10, various views of another embodiment of the air exhaust channel 118 arranged with the cooling fan 120 of the oven appliance 100 according to the present disclosure are illustrated. In particular, as shown, the debris diverter component 130 may include a tray 144 arranged and secured adjacent to the first opening 132 of the air exhaust channel 118. In such embodiments, the tray 144 is configured to direct the debris and/or the liquid that exits the first opening 132 away from the fan 120. In particular, as shown, the tray 144 includes a first end 146 and second end 148, with the first end 146 being arranged adjacent to the first opening 132 of the debris diverter component 130 and the second end 148 being arranged adjacent to the second opening 142 of the vertically-oriented wall 122. Therefore, as shown via arrow 150, the debris/liquid exits the first opening 132 and onto the tray 144. After being directed via the tray 144 to the wall 122, the debris/liquid can then pass through the second opening 142 in the wall 122 on an exterior side of the wall 122 and away from the fan 120.

In addition, as shown particularly in FIGS. 9 and 10, the tray 144 may be recessed within the vertically-oriented wall 122. Moreover, in an embodiment, the tray 144 may be removable from within the vertically-oriented wall 122 such that collected debris or liquid can be expelled from the tray 144 and/or such that the tray 144 can be cleaned as needed.

Figure 11:
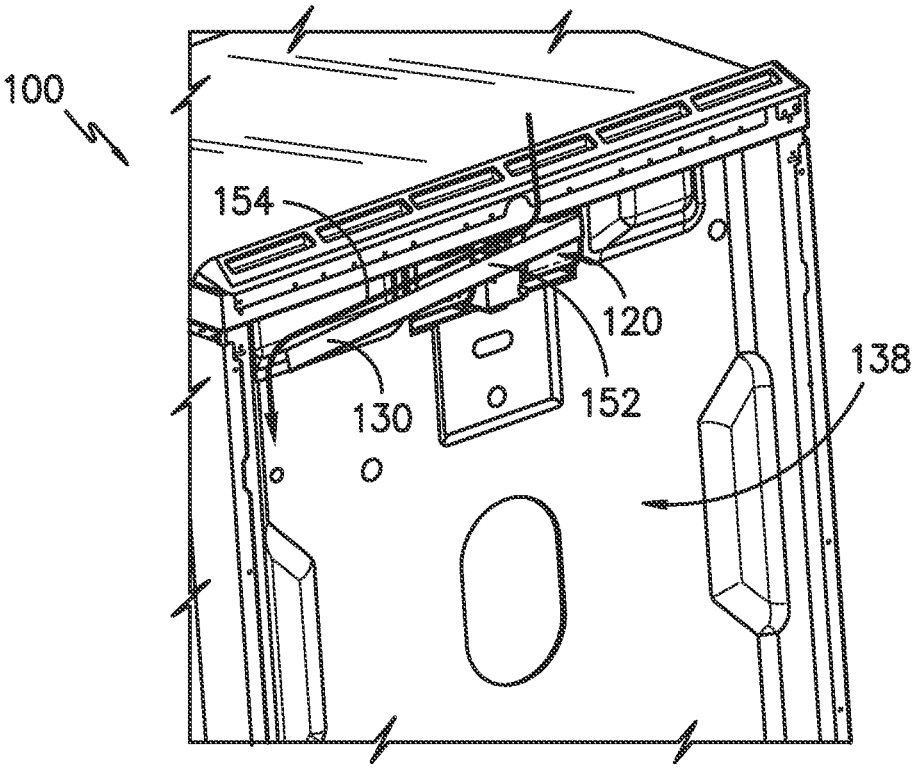
FIG. 11 illustrates a rear view of an embodiment of an oven appliance according to the present disclosure, particularly illustrating a rear wire cover removed to illustrate details of a debris diverter component configured as a channel.
Figure 12:
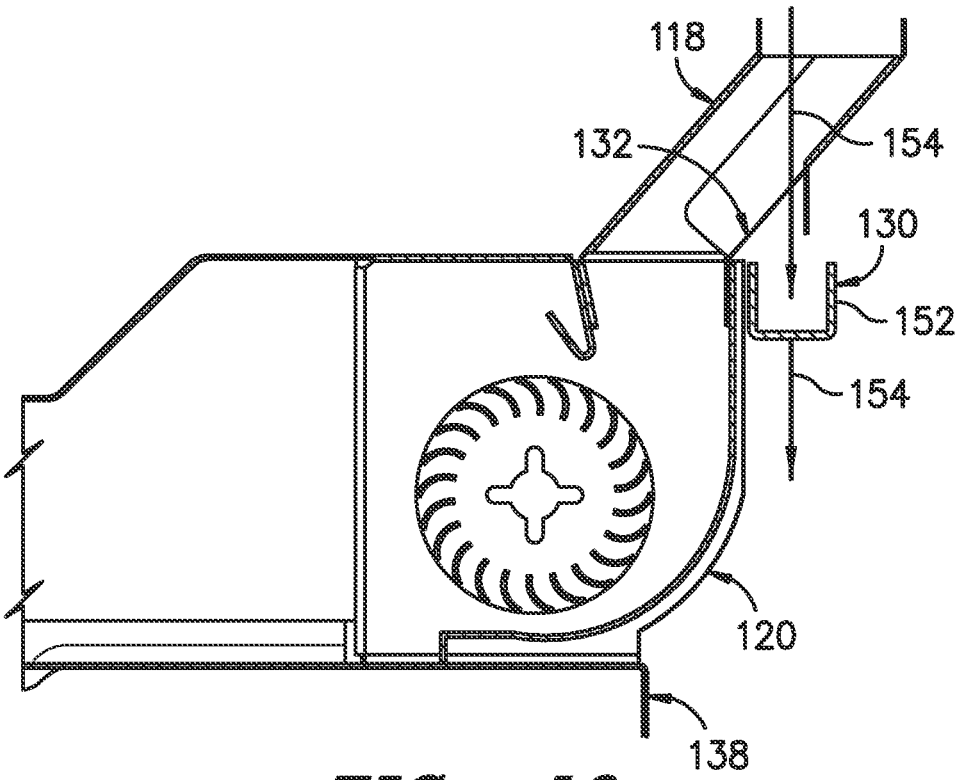
FIG. 12 illustrates an internal, side view of the oven appliance of FIG. 11.

Referring now to FIGS. 11-12, various views of still another embodiment of the air exhaust channel 118 arranged with the cooling fan 120 of the oven appliance 100 according to the present disclosure are illustrated. In particular, as shown, the rear wire cover 122 (e.g. as shown in FIGS. 3, 4, 6, 7, 9, and 10) has been removed to further illustrate the internal components thereof. Thus, in such embodiments, the first opening 132 of the debris diverter component 130 is configured to divert the debris and/or the liquid that exits the first opening 132 via gravity to a location, e.g. within the vertically-oriented wall 122. In particular, as shown, the debris diverter component 130 may include a channel 152 secured adjacent to the first opening 132 of the debris diverter component 130 for directing the debris and/or the liquid (arrow 154) that exits the first opening 132 away from the fan 120 and to a side of the oven appliance 100 (e.g. the right or left side) within the vertically-oriented wall 122. Thus, the channel 152 can direct the debris/liquid away from other parts that may also be damaged thereby. Further, as shown particularly in FIG. 11, the channel 152 may be secured at an angle to allow gravity to assist the debris/liquid collection.

Figure 13:
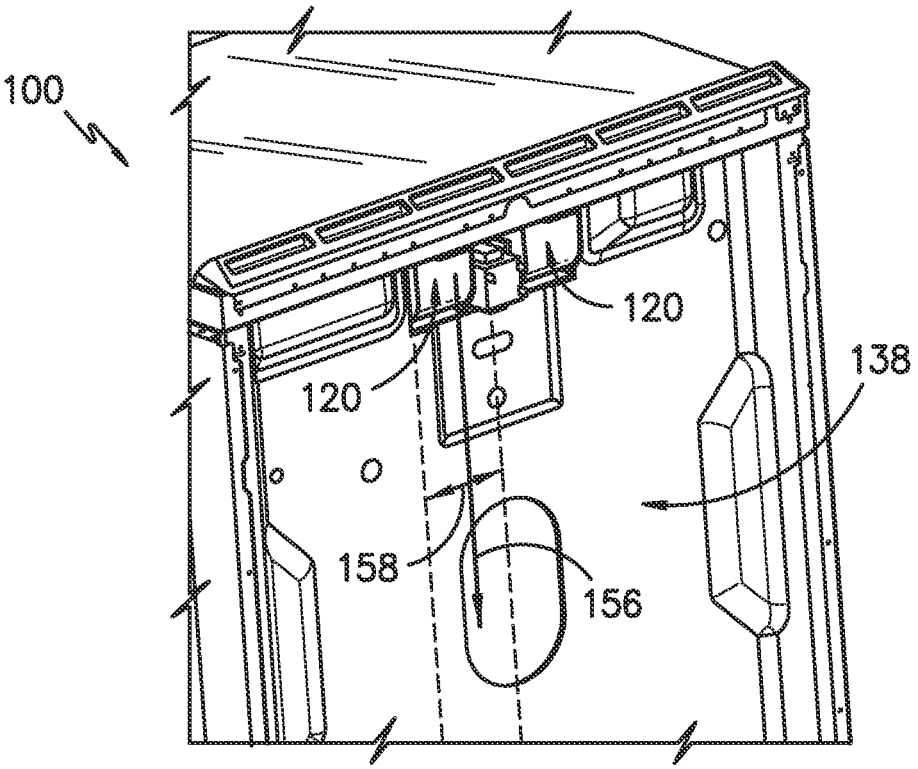
FIG. 13 illustrates a rear view of an embodiment of an oven appliance according to the present disclosure, particularly illustrating a rear wire cover removed to illustrate details of a debris diverter component configured as an opening in an air exhaust channel.
Figure 14:
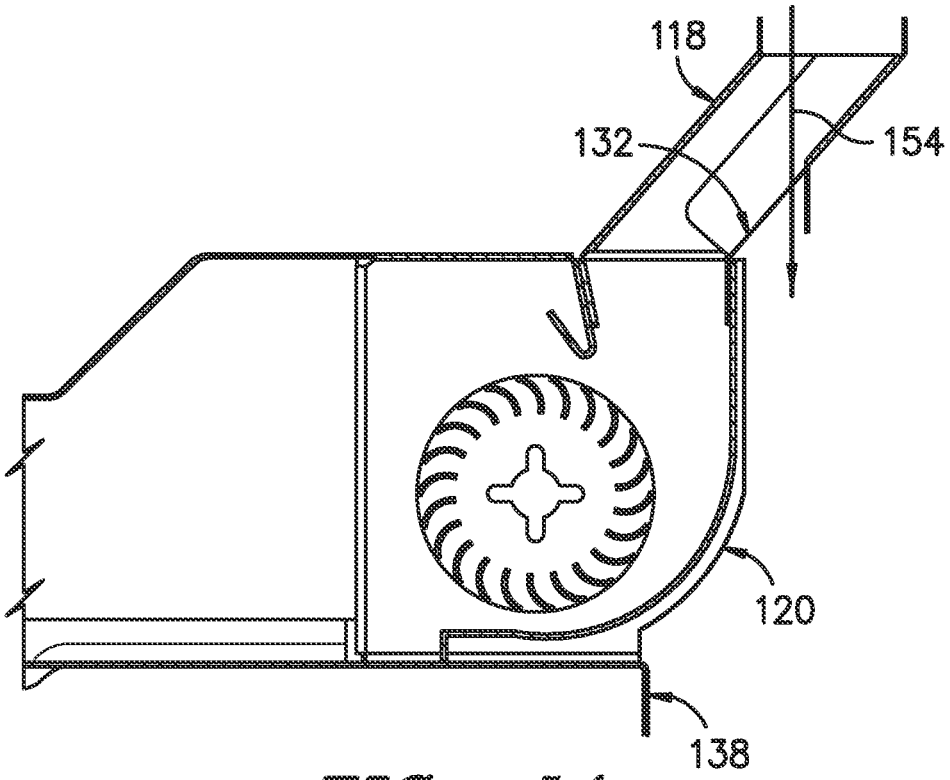
FIG. 14 illustrates an internal, side view of the oven appliance of FIG. 13.

Referring now to FIGS. 13 and 14, various views of yet another embodiment of the air exhaust channel 118 arranged with the cooling fan 120 of the oven appliance 100 according to the present disclosure are illustrated. In particular, as shown, the rear wire cover 122 has been removed to further illustrate the internal components thereof. In such embodiments, the first opening 132 of the debris diverter component 130 can be positioned so as direct the debris/liquid (e.g. arrow 156) directly below the first opening 132. In such embodiments, as indicated by the area 158 between the dotted lines 158 in FIG. 13, the area 158 between the vertically-extending structural wall 138 of the oven appliance 100 and the rear wire cover 122 may be absent of components that can be damaged via the debris and/or the liquid (such as, for example, electrical components). In other words, parts that can be damaged via debris/liquid are generally not located below the air exhaust channel 118. Therefore, the debris diverter component 130 directs the debris/liquid away from the fan 120 as well as other components that could be damaged thereby, to safe area 158, all of which is inside of the wall 122.

Referring now to FIG. 15, a flow diagram of a method 200 for preventing debris or liquid from damaging a fan of an oven appliance is illustrated. In general, the method 200 is described herein as relating to the oven appliance 100 described herein. However, it should be appreciated that the disclosed method 200 may be implemented using any other suitable oven appliance now known or later developed in the art and is also not limited to oven appliances. In addition, although FIG. 15 depicts steps performed in a particular order for purposes of illustration and discussion, the methods described herein are not limited to any particular order or arrangement. One skilled in the art, using the disclosures provided herein, will appreciate that various steps of the methods can be omitted, rearranged, combined and/or adapted in various ways.

As shown at (202), the method 200 includes providing an air exhaust channel having an air inlet and an air outlet adjacent to the fan. As shown at (204), the method 200 includes operating the fan to direct air to flow from adjacent to a cooking chamber of the oven appliance, through the air inlet of the air exhaust channel, and out of the air outlet of the air exhaust channel. During operation of the fan, as shown at (206), the method 200 includes diverting debris or liquid entering the air outlet of the air exhaust channel away from the fan. For example, in an embodiment, diverting the debris or the liquid entering the air outlet of the air exhaust channel away from the fan may include directing the debris or the liquid through a first opening formed in a lower surface of the air exhaust channel, wherein the debris or the liquid exits the first opening via gravity.

In another embodiment, the method 200 may include directing the debris or the liquid exiting the first opening to a location within at least one vertically-oriented wall. In such embodiments, the location may be absent of components that can be damaged via the debris or the liquid.

In yet another embodiment, the method 200 may include directing the debris or the liquid exiting the first opening through a second opening of at least one vertically-oriented wall. In such embodiments, the vertically-oriented wall may include an inset region. Thus, the debris and/or the liquid that exits the second opening of the vertically-oriented wall can be further diverted away from the fan via the inset region of the vertically-oriented wall.

In still another embodiment, the method 200 may include directing the debris or the liquid exiting the first opening to a tray secured adjacent to the first opening that further directs the debris or the liquid away from the fan and through a second opening of at least one vertically-oriented wall.

In additional embodiments, the method 200 may include directing the debris or the liquid exiting the first opening through a channel secured adjacent to the first opening away from the fan to a side of the oven appliance within the vertically-oriented wall.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, comprising:

a cooking chamber for receipt of a food for cooking;

an air exhaust channel comprising an air inlet and an air outlet, the air inlet for directing air flowing adjacent to the cooking chamber into the air exhaust channel, the air outlet for directing the air out of the air exhaust channel;

a fan for causing the air to flow from adjacent to the cooking chamber and through the air exhaust channel;

a debris diverter component arranged with the air exhaust channel for preventing debris or liquid from contacting the fan, the debris divider component comprising a first opening; and at least one vertically-orientated wall comprising a second opening, wherein the second opening of the at least one vertically-oriented wall is aligned with the first opening of the debris diverter component, wherein the debris or the liquid exits the first opening of the debris diverter component via gravity and then exits the second opening of the at least one vertically-oriented wall, wherein the air exhaust channel further comprises a body extending at an angle between the air inlet to the air outlet, the angle being less than 90 degrees, and wherein the first opening of the debris diverter component is formed in a lower surface of the angled body of the air exhaust channel.

2. The oven appliance of claim 1, wherein the first opening of the debris diverter component diverts the debris or the liquid that exits the first opening via gravity to a location within the at least one vertically-oriented wall, the location being absent of components that can be damaged via the debris or the liquid.

3. The oven appliance of claim 1, the at least one vertically-oriented wall further comprises an inset region, and wherein the debris or the liquid that exits the first opening of the debris diverter component via gravity and exits the second opening of the at least one vertically-oriented wall and is further diverted away from the fan via the inset region of the at least one vertically-oriented wall.

4. The oven appliance of claim 1, wherein the debris diverter component further comprises a tray secured adjacent to the first opening for directing the debris or the liquid that exits the first opening away from the fan.

5. The oven appliance of claim 4, wherein the tray comprises a first end and second end, the first end arranged adjacent to the first opening of the debris diverter component, the second end arranged adjacent to the second opening of the at least one vertically-oriented wall for directing the debris or the liquid that exits the first opening away from the fan and through the second opening.

6. The oven appliance of claim 5, wherein the tray is recessed within the at least one vertically-oriented wall.

7. The oven appliance of claim 6, wherein the tray is removable from within the at least one vertically-oriented wall such that collected debris or liquid can be expelled from the tray.

8. The oven appliance of claim 1, wherein the debris diverter component further comprises a channel secured adjacent to the first opening of the debris diverter component for directing the debris or the liquid that exits the first opening away from the fan and to a side of the oven appliance within the at least one vertically-oriented wall.

9. The oven appliance of claim 1, wherein the at least one vertically-oriented wall is a rear wire cover.

10. The oven appliance of claim 1, wherein the fan is positioned below the air exhaust channel.

11. A method for preventing debris or liquid from damaging a fan of an oven appliance, the method comprising:

providing an air exhaust channel having an air inlet and an air outlet adjacent to the fan;

operating the fan to direct air to flow from adjacent to a cooking chamber of the oven appliance, through the air inlet of the air exhaust channel, and out of the air outlet of the air exhaust channel; and during operation of the fan, diverting debris or liquid entering the air outlet of the air exhaust channel away from the fan by directing the debris or the liquid through a first opening of the air exhaust channel; and directing the debris or the liquid exiting the first opening through a second opening of at least one vertically-oriented wall, wherein the debris or the liquid that exits the second opening of the at least one vertically-oriented wall and is further diverted away from the fan, wherein the debris or the liquid exits the first opening via gravity, wherein the air exhaust channel further comprises a body extending at an angle between the air inlet to the air outlet, the angle being less than 90 degrees, and wherein the first opening of the debris diverter component is formed in a lower surface of the angled body of the air exhaust channel.

12. The method of claim 11, further comprising directing the debris or the liquid exiting the first opening to a location within at least one vertically-oriented wall, the location being absent of components that can be damaged via the debris or the liquid.

13. The method of claim 11, wherein the at least one vertically-oriented wall further comprises an inset region, and wherein the debris or the liquid that exits the second opening of the at least one vertically-oriented wall and is further diverted away from the fan via the inset region of the at least one vertically-oriented wall.

14. The method of claim 11, further comprising directing the debris or the liquid exiting the first opening to a tray secured adjacent to the first opening that further directs the debris or the liquid away from the fan and through a second opening of at least one vertically-oriented wall.

15. The method of claim 11, further comprising directing the debris or the liquid exiting the first opening through a channel secured adjacent to the first opening away from the fan to a side of the oven appliance within the at least one vertically-oriented wall.

16. An oven appliance, comprising:

a cooking chamber for receipt of a food for cooking;

an air exhaust channel comprising an air inlet and an air outlet, the air inlet for directing air flowing adjacent to the cooking chamber into the air exhaust channel, the air outlet for directing the air out of the air exhaust channel;

a fan for causing the air to flow from adjacent to the cooking chamber and through the air exhaust channel;

a debris diverter component arranged with the air exhaust channel for preventing debris or liquid from contacting the fan, the debris divider component comprising a first opening; and at least one vertically-orientated wall comprising a second opening, wherein the second opening of the at least one vertically-oriented wall is aligned with the first opening of the debris diverter component, wherein the debris or the liquid exits the first opening of the debris diverter component via gravity and then exits the second opening of the at least one vertically-oriented wall, wherein the at least one vertically-oriented wall further comprises an inset region, and wherein the debris or the liquid that exits the first opening of the debris diverter component via gravity and exits the second opening of the at least one vertically-oriented wall and is further diverted away from the fan via the inset region of the at least one vertically-oriented wall.

17. The oven appliance of claim 16, wherein the first opening of the debris diverter component diverts the debris or the liquid that exits the first opening via gravity to a location within the at least one vertically-oriented wall, the location being absent of components that can be damaged via the debris or the liquid.

18. The oven appliance of claim 16, wherein the debris diverter component further comprises a channel secured adjacent to the first opening of the debris diverter component for directing the debris or the liquid that exits the first opening away from the fan and to a side of the oven appliance within the at least one vertically-oriented wall.

19. The oven appliance of claim 16, wherein the at least one vertically-oriented wall is a rear wire cover.

20. The oven appliance of claim 16, wherein the fan is positioned below the air exhaust channel.

* * * * *